US006986856B2

(12) United States Patent
Pitkanen

(10) Patent No.: US 6,986,856 B2
(45) Date of Patent: Jan. 17, 2006

(54) METHOD OF CASTING, THE FORM USED THEREBY AND ELEMENT PRODUCED THEREFROM

(75) Inventor: Veijo Olavi Pitkanen, Kangasala (FI)

(73) Assignee: Suomen Muuraustyo SMT Oy, Lempaala (FI)

( * ) Notice: Subject to any disclaimer, the term of this patent is extended or adjusted under 35 U.S.C. 154(b) by 333 days.

(21) Appl. No.: 10/257,708

(22) PCT Filed: Apr. 17, 2001

(86) PCT No.: PCT/FI01/00374

§ 371 (c)(1),
(2), (4) Date: Oct. 15, 2002

(87) PCT Pub. No.: WO01/87564

PCT Pub. Date: Nov. 22, 2001

(65) Prior Publication Data

US 2003/0137081 A1 Jul. 24, 2003

(30) Foreign Application Priority Data

Apr. 17, 2000 (FI) ..... 20000907

(51) Int. Cl.
*B28B 7/02* (2006.01)

(52) U.S. Cl. ..... 264/219; 264/313; 249/82; 249/102; 249/128; 249/160

(58) Field of Classification Search ..... 264/219, 264/313; 249/82, 102, 128, 160
See application file for complete search history.

(56) References Cited

U.S. PATENT DOCUMENTS

| | | | | |
|---|---|---|---|---|
| 1,423,284 | A * | 7/1922 | Weaver | 249/100 |
| 3,635,613 | A * | 1/1972 | Marsh et al. | 425/62 |
| 4,397,583 | A | 8/1983 | Horncy et al. | 405/150 |
| 4,529,162 | A | 7/1985 | Tsuzuki | 249/158 |
| 4,673,159 | A * | 6/1987 | Schmidgall | 249/159 |
| 5,372,349 | A * | 12/1994 | Elmore | 249/112 |
| 5,542,837 | A * | 8/1996 | Johnston | 425/183 |
| 6,086,349 | A * | 7/2000 | Del Monte | 425/62 |

FOREIGN PATENT DOCUMENTS

| | | |
|---|---|---|
| FR | 2732714 | 10/1996 |
| GB | 647675 | 12/1950 |
| GB | 1166307 | 10/1969 |
| GB | 1540244 | 2/1979 |

* cited by examiner

*Primary Examiner*—Suzanne E. McDowell
(74) *Attorney, Agent, or Firm*—Perman & Green, LLP.

(57) ABSTRACT

The object of this invention is the method of manufacture of a symmetric element of a round ring and cone-shaped ring applicable in serial production. The application area of the invention is particularly the prefabrication of ceramic coating elements, which match together and which are assembled in straight walls, a surface coating containing cylinder rings and cone-shaped rings. Good application objects are for example the cyclones and the ducts of circulating bed boilers, carburetor plants, etc. various combustion chambers and high temperature devices. The concerned elements have special conditions concerning their tightness, so that their seam surfaces must be shaped so that they are profile surfaces differing from plane surfaces, profile surfaces having the capacity to resist to leakage through seam better than straight surfaces.

19 Claims, 11 Drawing Sheets

METHOD OF CASTING, THE FORM USED THEREBY AND ELEMENT PRODUCED THEREFROM

This application claims the benefit of the earlier filed International Application No. PCT/FI01/00374, International Filing Date, Apr. 17, 2001, which designated the United States of America, and which international application was published under PCT Article 21 (2) as WO Publication No. WO 01/87564 A1.

This invention has for object a method applicable to the manufacture of an element having the form of a round ring and being nearly symmetric with one, two surfaces, in which method the radial boundary surfaces of the mould to be used are essentially mutually fitting profile surfaces and the boundary surfaces that are perpendicular to the central axis of the cylinder surface are also mutually fitting profile surfaces and nearly rotation surfaces of their profiles round the central axis of the cylinder surface of the mould and to the extent indicated by the mentioned surface, as well as a method applicable to the manufacture of an element having the form of a cone ring that is nearly symmetric with one, two surfaces, in which method the radial surfaces of the used mould are essentially mutually fitting profiles and the boundary surfaces that are perpendicular to the cone surface are also profile surfaces and nearly rotation profiles round the central axis of the cone surface of the mould so that the interior radius of the mentioned surface corresponds to the radius of the cone surface when on it.

The area of application is particularly the pre-fabrication of ceramic coating elements that match each other and that are used to assembly straight walls, cylinder rings and cone-shaped rings or a uniform fire-resistant surface coating containing their elements. Good objects of application are for example the cyclones of circulating bed boilers and ducts, carburetor installations, steel industry devices, etc. and various combustion chambers and high temperature equipment. The mentioned elements demand particular conditions concerning the tightness so that the seam surfaces of the elements have to be shaped so that they form profile surfaces differing from plane surfaces, the profile surfaces being characterized by that they resist better than straight interfaces to the leakage through the seam. The approximate symmetry mentioned at the beginning of the description means in the present application that the female and male profiles of the interfaces of the element are not considered causing asymmetry of the elements.

The above mentioned elements are today manufactured by two types of casts and methods: The cast pieces having the form of the elements of the cylinder and cone-shaped rings are cast in moulds, peculiar to each project, which are made for example of stainless steel individually always in the form that is indicated by the piece to be cast. The interfaces of the mould are joined together so that the mould can be dismantled and the cast can be renewed with the same mould several times enough. For each necessary diameter, coating thickness and cone angle is manufactured own individual mould that is used only for the manufacture of the elements having the determined diameter and coating thickness. The mould is filled through an opening located in the middle of the back surface so that the shape of the back surface forms a perfect part of a polygon corresponding to its curvature. It is normal that one coating structure of the boiler or some other plant containing ceramic fire-proof coatings, includes several coating areas with different diameters and coating thickness, in which cases a separate own mould must be prepared for each area. The same, a separate own mould must be prepared for each layer of cone-shaped area. The normal height of layer according to known technology is ca. 250 mm, in which case a 4-m high cone demands 16 separate moulds for the manufacture of the cast pieces contained by it. Thus the mould that has once been prepared and used can be reused for the manufacture of spare parts and sometimes eventually in a new project when the diameters occasionally correspond. Concerning the cone-shaped elements, the cone angle must also correspond. (Coating thickness may be repeated in structures like a standard).

A second method used today in the manufacture of pre-cast coating elements is to build the mould of an easily workable material such as plywood in the way of cassettes so that it is possible to cast several pieces by one cast. This known technology does not use the profile called "tongue and groove" that is symmetric and the most profitable from the point of view of pre-fabrication, fitting and resistance, in those surfaces in which they are the rotation surfaces of their profiles (in the cylinder ring elements, the interfaces that are perpendicular with the central axle, in the cone-shaped elements, interfaces that are perpendicular with the cone-shaped surface), because their casting technology supposes the filling of the mould through the surface in question. Instead of them for example so-called lock joint profile is used. Even these moulds are manufactured according to each project in function of diameters, coating thickness and cone angles.

"Tongue and groove" means in the present context a profile that is known for example as a form of joining boards tightly together (FIGS. 8, 9). "Lock joint" means here a joint profile, in which the pieces to be joined interlock each other so that the seam forms a 3-part broken line that contains 2 approximate 90-degree angles and in which the middlemost part is essentially parallel with the surface of coating. The term "internal diameter" of the mould presented in this description and the patent claim also includes the special case in which the mentioned diameter is unlimited.

The term "approximate rotation surface" means, when it is mentioned in the description and claims, a surface similar to the rotation surface having straight surface parts which in their global effect comply with the approximate respective rotation surface.

As a negative aspect in the application of the first presented technology can be considered that the moulds are mainly non-reusable. For that reason the manufacture of moulds is expensive and the consequent costs tend to be minimized by manufacturing those moulds as few as possible, often only one piece for each coating area. That has for negative result that the delivery periods of elements are long and cause for their part many kinds of problems. The number of manufactured pieces normally being in respect of each project several hundreds, it is necessary to take the decision one by one concerning the relationship between the period of manufacture and the number of pieces to be manufactured. The costs of manufacture of one single mould are today several thousands of Marks. The re-use of the manufactured moulds is only occasional and in order to profit of this eventuality the moulds must be stockpiled for the future. On that background we can consider that the stock of moulds piled during years can be considered as a negative aspect due to modern technology. For the above-mentioned reasons, the price level of the pre-fabricated elements is so high that can seldom compete with the coating cast on place. However, the practice and the tests of laboratory have revealed that the coating that is pre-fabricated in a plant is clearly of higher quality than the coating that is cast on place. The fact that the costs creep up when the quality of the product improves and there is consequent loss of competitiveness can be considered as a great disadvantage in the application of modern technology.

The technology using on the edges of the mould, for the reasons of casting technology, asymmetric profile surfaces such as "tongue and groove" aims at reducing moulding costs. Thus the use of the mould takes place by this method through one profile surface. As a disadvantage can be considered the fact that the coating contains, due to the form of the profile, several elements of various forms, for which it is necessary to manufacture separate own moulds. As already mentioned, it is known that from the point of view of fitting and resistance, the best result in element structures is reached by means of elements in which the profiles of all interfaces are coherent and follow for example so-called benefic tongue and groove profile. The anchor elements which are set, according to known technology, in coating in every two element layer and there as every two element, create, when the so-called tongue and groove profile or some other similar profile simplifying the manufacture is used, the problem that the elements located in the anchor row and the elements of the row between them, and the elements located in the anchor row between the anchor elements must be manufactured each one by a mould of different form. According to known technology, the anchor element needs to be different from normal elements only in that it has in its back surface a projecting part for anchor elements (e.g. sleeve and bolt). The fact that it is necessary to abandon the structure giving the best possible final result, for the reasons of manufacture technology, can be considered as a great disadvantage. As the moulds including the known technology are also non re-usable tools, the costs of moulds are high and that is to be considered as a great disadvantage too. Moreover, the mentioned technology complicates the fitting, which can be considered as a disadvantage.

The above mentioned technology is used, among others, in the production of fire-proof material by the Danish manufacturer, Hasle Isomax, and in that of Finnish Suomen Muuraustyö SMT Oy (Finnish Masonry Co) working in coating design and fitting.

The aim of this invention is to create a technology that allows avoiding the disadvantages of the known technologies. Characteristics relevant to the technology and the production according to the invention are presented in the presentation of characteristics of the patent claims 1 and 2.

As the most important advantage of the invention, compared to the known technology, can be considered the fact that the mould can be fitted in its all parts or alternatively nearly in its all parts on any diameter on its large operation area. The same, the mould intended for the manufacture of the cone-shaped elements can be set on any cone angle in its operation area. For this reason, one mould can be used continually and for the prefabrication of coatings with various thicknesses and for the manufacture of elements with different cone angles from one project to another. The same, one can consider as an important advantage the fact that it is possible to manufacture in one mould several matching elements for the same coating area by one cast, so that the periods of delivery and the costs of the mould are not in contradiction. The fact that all the straight and cylinder-like elements of coating, on the one hand, and all the cone-shaped elements, on the other hand, can be manufactured by one mould, can be considered as an undisputed advantage. The fact that it is possible to use the interface of the element, which is the most appropriate from the point of view of fitting and resistance, is also an undisputed advantage. An undisputed advantage also comes from the fact that the moulds, which are applicable to the manufacture of a round ring, are also applicable to the manufacture of straight surfaces.

The mould used in the method is described more in details in the attached drawings, in which:

In FIG. 15, the body is set in its smallest possible breadth and in FIG. 16 the mould is broadened.

Figure 1:
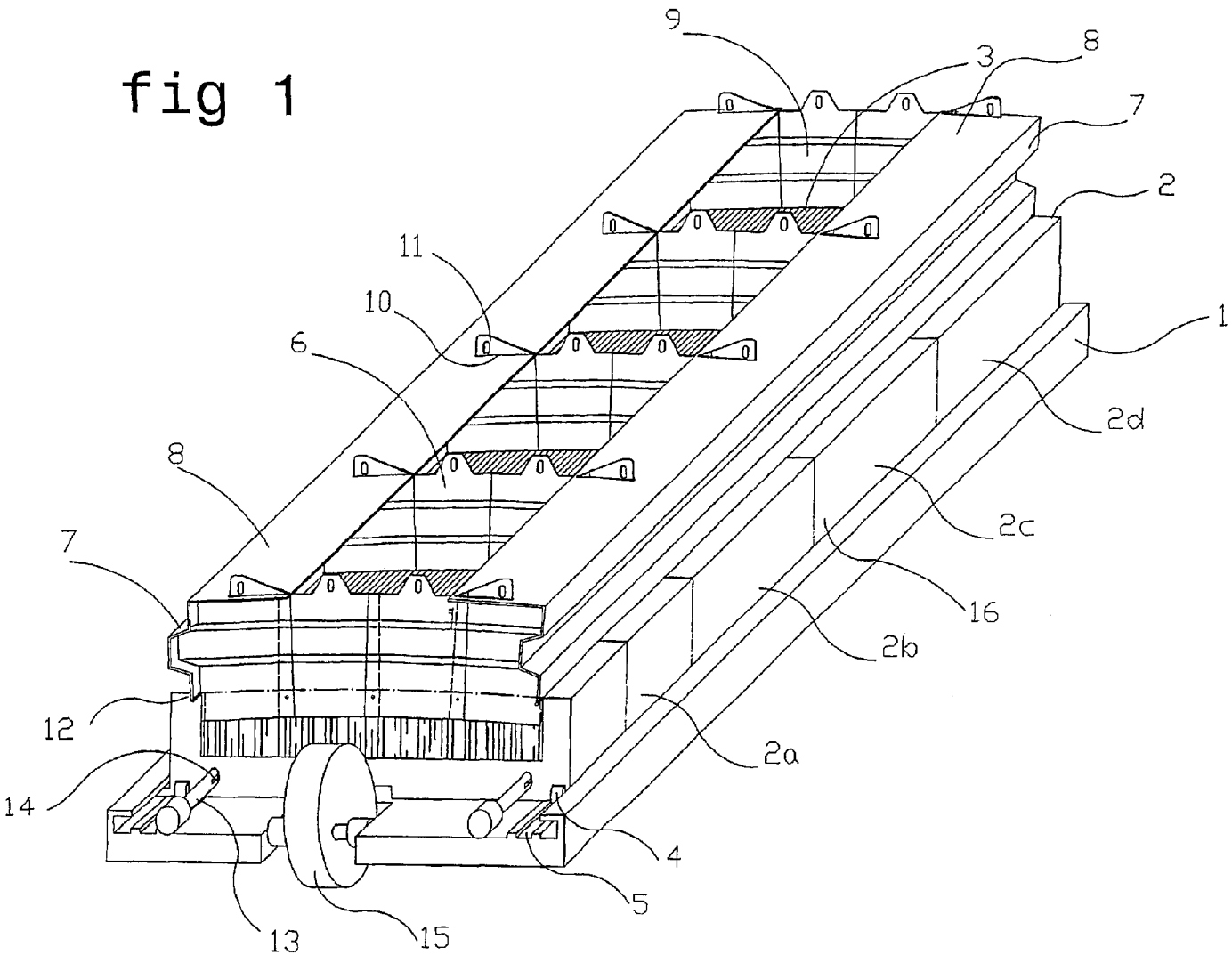
FIG. 1, represents a general view of the casting structure applicable to the manufacture of the parts of the cylinder ring in the casting position.

In FIG. 1, the mould and its main elements are presented in a position, in which the mould is ready for filling. On the stand 1 are in this example the four arched cylinder surfaces 3 necessary to simultaneous manufacture of four cast pieces. These elements in the mould are either non-reusable or adjustable in their measures. Each one is fixed in the corresponding elements 2*a*, 2*b*, 2*c* and 2*d* of the 4-element body 2. These elements are each connected to the stand 1 so that the transfer organs such as wheels 4 are in the tracks 5. Between the arched cylinder surfaces 3 and moreover at the end of the outmost surfaces are 4 elements containing profile plate fans 6 that operate as straight boundary surfaces which are perpendicular with the axis of the cylinder of the spaces to be cast, and that are fixed in the arched cylinder surfaces 3 in the way which is later explained in the present description. The profile plates 7 operating as radial surfaces are on the sides of the cylinder surface. These plates are fixed with hinges in the body 2 or in the arched cylinder surfaces 3. Radial profile plates continue uniform or as extension plates fixed in them 8 curving on the mould in the point where they form the upper boundary surfaces of the mould. The opening 9 between the ends of the extension plates 8 operates as the opening for the filling of the mould. The plates 7 and their extension plates 8 are as long as the whole structure of the mould and the ends of the profile fan plates 6 are tightly fixed in the plates 7 and a part of their upper edge in the extension plates 8. The extension plates 8 have the holes 10 located in the face of the profile fan plates 6. Then the mould is assembled the projecting parts 11 enter the holes 10. The plates are locked together by some practical way, for example by pulling the wedges into the holes of the projecting parts 11. The part of the back surface of the normal element (not anchor element) that is between the upper extension plates 8 becomes in casting a horizontal plane surface without the mould element defining its place and form.

Figure 2:
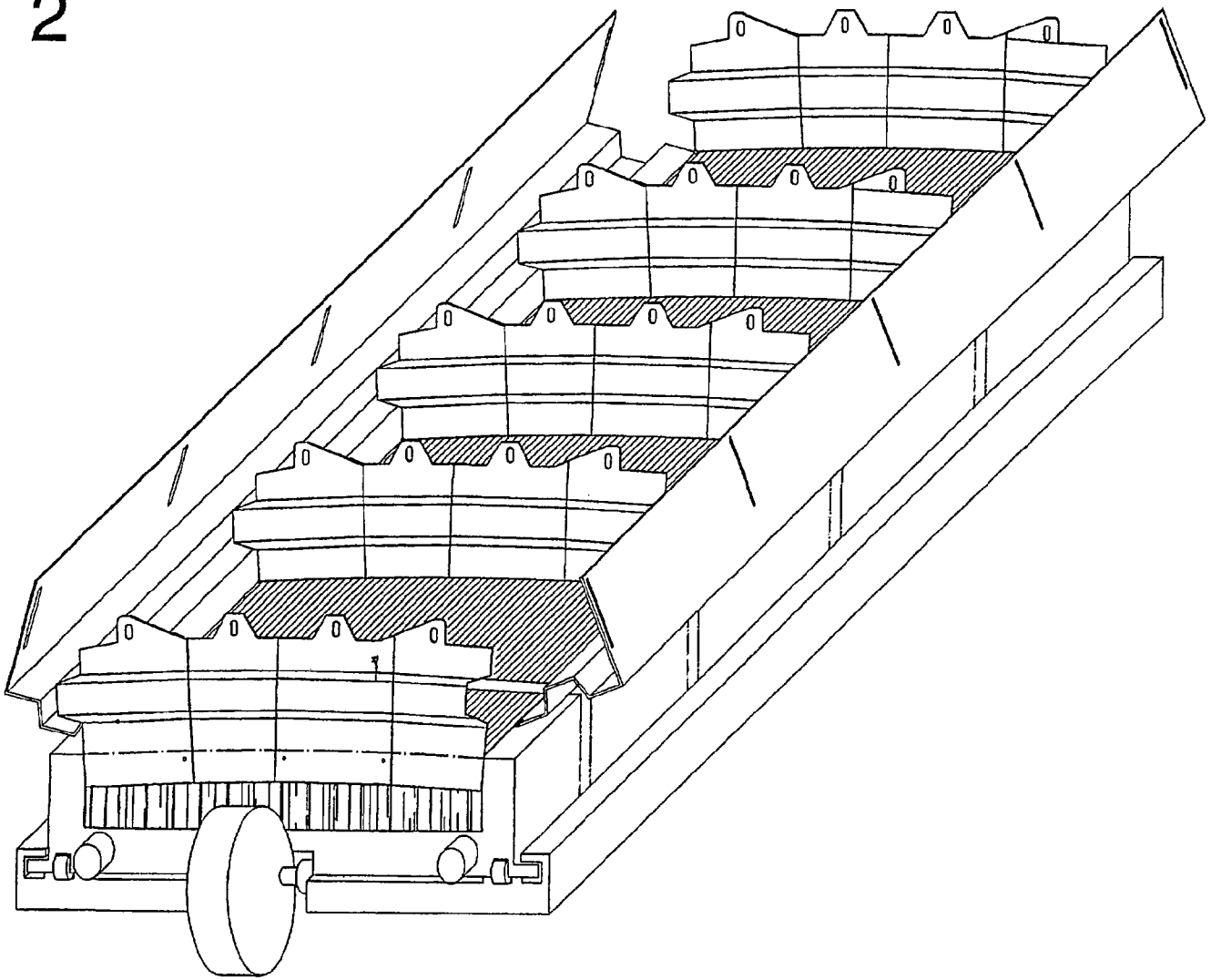
FIG. 2, represents a general view of the casting structure applicable to the manufacture of the cylinder ring in the position, in which casting pieces are dismantled from the mould.

Once the mould is filled and the cast pieces are hard, the mould will be opened in the position indicated by FIG. 2 in the following way. The wedges keeping together the fan profile plates 6 and extension plates 8 are taken away or the locking that may be otherwise arranged, is opened and the plates 7 and the extension plates 8, which have been greased before casting, are turned over the hinge 12 so that the plates do not prevent lifting away the cast pieces The locking device 14 located on the direction axis 13 (FIG. 1) that keeps together the elements of the body 2*a*, 2*b*, 2*c* and 2*d*, are opened and the pressure device, e.g. the eccentric 15 is returned back to the opposite position. The opening device between the elements 2*a*, 2*b*, 2*c*, and 2*d* of the body, such as the springs 16 pull the elements apart. The opening device that is between the parts of the opening device that contains 2 elements, pulls these parts apart. Each one of the 5 fan profile plates 6, parts of the mould, is fixed in a different arch cylinder surface 3 and thus follows at the opening of the mould its own arched cylinder surface. After opening of the mould, the gaps between the arched cylinder surfaces are so large that the casting elements can be taken away upwards without any obstacle. The plates 7 are provided with hinges so that the longitudinal movement of the blocks can take place. The mould is assembled to its casting position in the opposite order compared to its dismantling. The boundary surfaces are greased, the blocks of the mould are pressed together with the pressure device 15 and locked tightly in place with the locking device 14. The moving of the elements 2*a*, 2*b*, 2*c* and 2*d* together when the mould is dismantled can also take place so that the direction axis 13 operate as the holders of the elements and they are made to glide to their right position along the bars 13. The side and the upper surfaces, plate 7 and extension plate 8, are turned over the hinge to their places and they are locked to the fan profile plates 6. The structure of the hinge can be the following: on the lower surface of the plate 7 is fixed a pipe that is as long as the mentioned pipe. Inside the pipe is an axle that is longer than the pipe and that is supported by the holders at the ends of the outmost blocks 2*a* and 2*d* of the mould. When the mould is opened, at least one of the holders of the axle glides on the axle when the block moves. The difference of length between the axle and the pipes is at least the length of the extension demanded at the opening of the mould. The mould is filled through the opening 9 located between the extension plates 8. The back circle of the cast piece becomes according to known technology a part of a polygon. At the moment of filling, the polygonal back surface of the element is fixed in the cylinder element of the coating or the structure tightly with mortar according to known technology.

Figure 7:
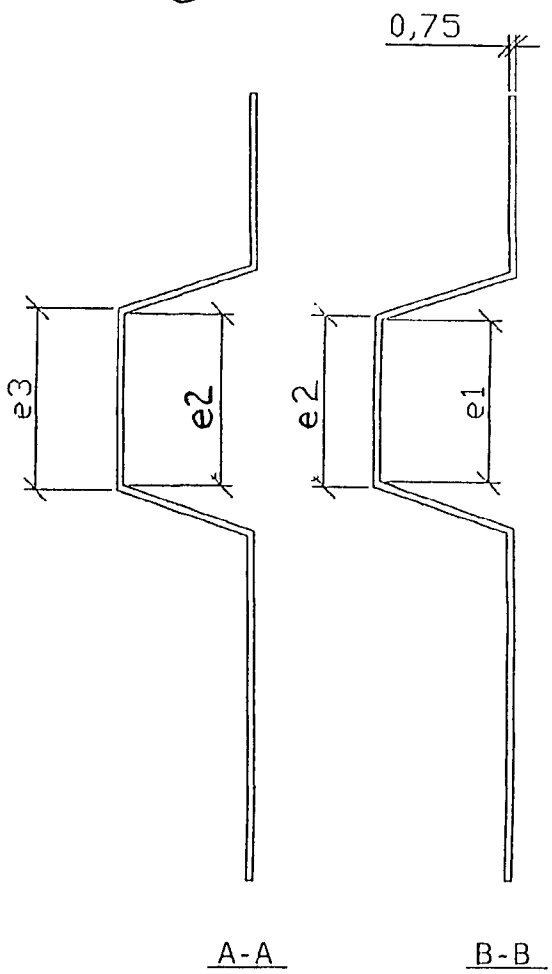
FIGS. 5, 6 and 7 represent a series of profile plates, part of the mould, formed by a boundary surface similar to a rotation surface, and individual plates, parts of it.
Figure 5:
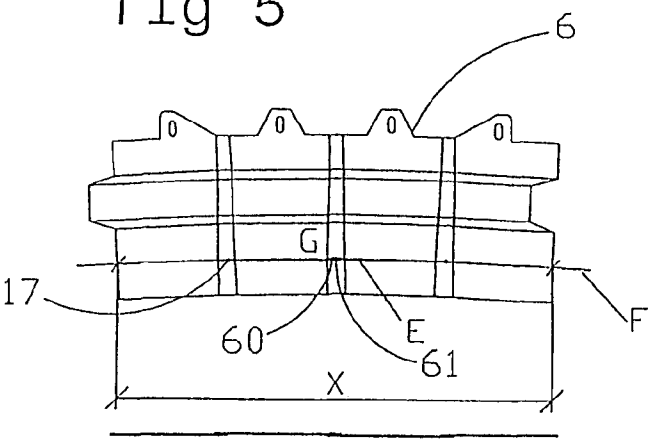
Figure 6:
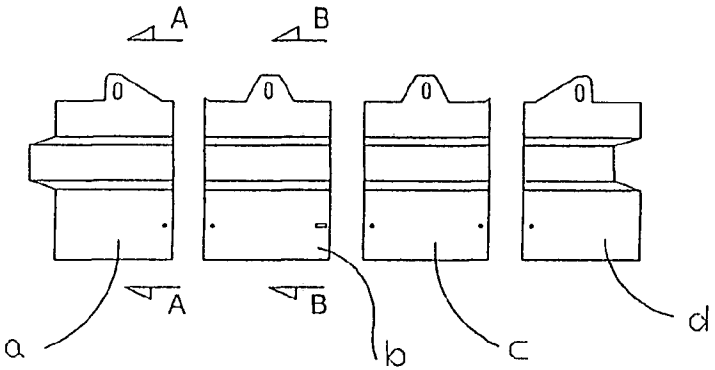
Figure 9:
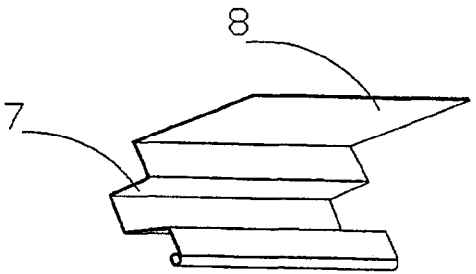
FIG. 9, represents a profile plate, part of the mould, forming a radial boundary surface in the mould applicable to the manufacture of the elements of a cone-shaped ring.
Figure 8:
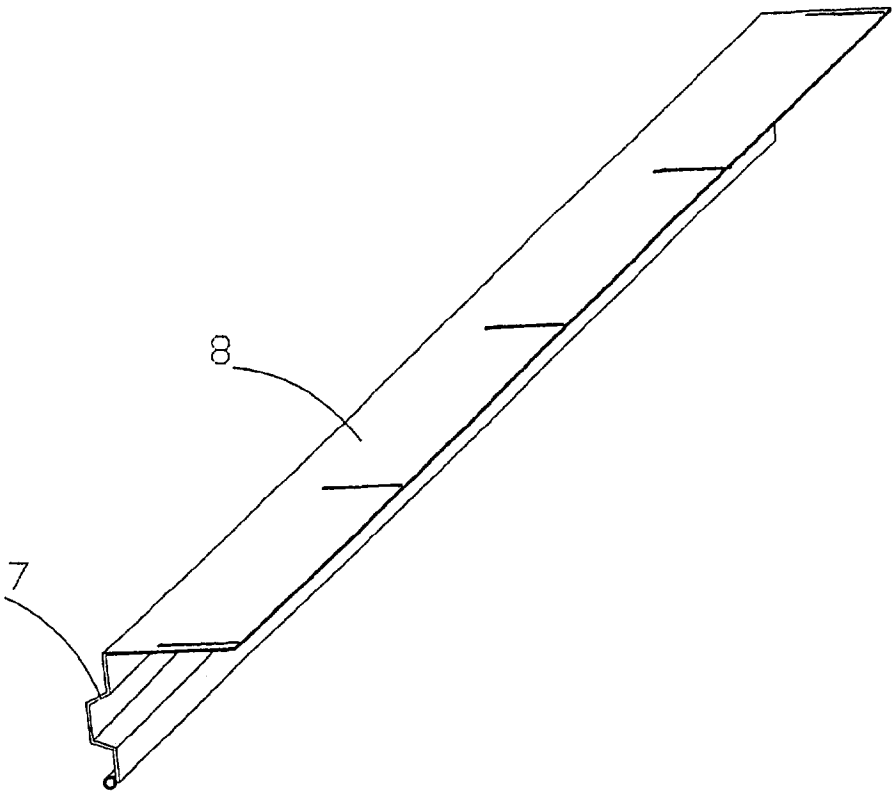
FIG. 8, represents a profile plate, part of the mould, forming a radial boundary surface in the mould applicable to the manufacture of the elements of a cylinder ring.

FIGS. 5, 6 and 7 represent a fan series according to the invention operating as follows: The four elements a, b, c and d represented in FIG. 6 are made of a thin plate and they are profiled so that if they are pressed together according to FIG. 5, they match in their profiles. In other words, the measures of the profiles of the plates, which are side by side, differ from each other (FIG. 7, in view A—A dimension e2 is plus tolerance while in view B—B dimension e2 is minus tolerance) so that a tight biasing can be obtained. The adjacent plates are articulated together in the lower part 17 of the plates (FIG. 5). Once the arced elements having a new radius are set in the body of the mould, or the arched elements are regulated to correspond to the new radius, the articulated fan profile plates 6 are regulated so that the radius of the arc F following the broken line E of the entity of plates is as long as the radius of the surface of the mould's arched cylinder surface 3. There is in the central articulation a long-like hole 60, in which case the length of the fan profile plates series 6 can be adjusted by moving the articulation axle 61 so that the length of the spring corresponding to the arch of the mould of the fan profile plate series 6 becomes as long as the length of the tendon of the mould arc. After adjustments the fan profile plates 6 are fixed in the arched cylinder surfaces 3. The articulation points 17 of the plates are located on the circle F corresponding to the mould's arch, so that by means of a sufficient longitudinal adjustment extension of the central articulation, it is possible to find the solution in which the mould covers a very large applicable diameter area. The size of the mentioned longitudinal adjustment is nevertheless only a few millimeters or only parts of it, so that the same fan profile plates 6 are applicable in a very comprehensive way. The smaller is the diameter area, the bigger can be the needed adjustment extension, in which case the fan profile plates 6 in the mould can include more than one adjustable articulation.

When one wants to manufacture elements having a different coating thickness, the corresponding fan profile plates 6, plates 7 and extension plates 8 are changed in the mould. It is also possible to manufacture the fan profile plates 6 so that instead of the change, the plates can be readjusted by a new articulation adapted to new conditions. The radial plates 7 can be provided with a height-adjustment system so that instead of changing the plates 7, they are adjusted to the correct height. When the angle between the plates 7 and extension plates 8 is ca. 90 degrees and their material and thickness adapted to the situation, it is possible to press the extension plates 8 in the locking position in the whole operation area of the mould.

Differently from the above mentioned example, the plates 7 can be manufactured to have the length of one mould block or arched cylinder surface so that their wedges are set separately in each block and the assembling of the mould takes place in a different order so that before pressing the mould blocks or arched cylinder surfaces 3 together the plates and extension plates 8 are put in the working position. By this way of realization of the invention it is possible to obtain the advantage that when it is otherwise possible, it is not necessary to make the fan profile plate series 6 adjustable as to its length.

Figure 3:
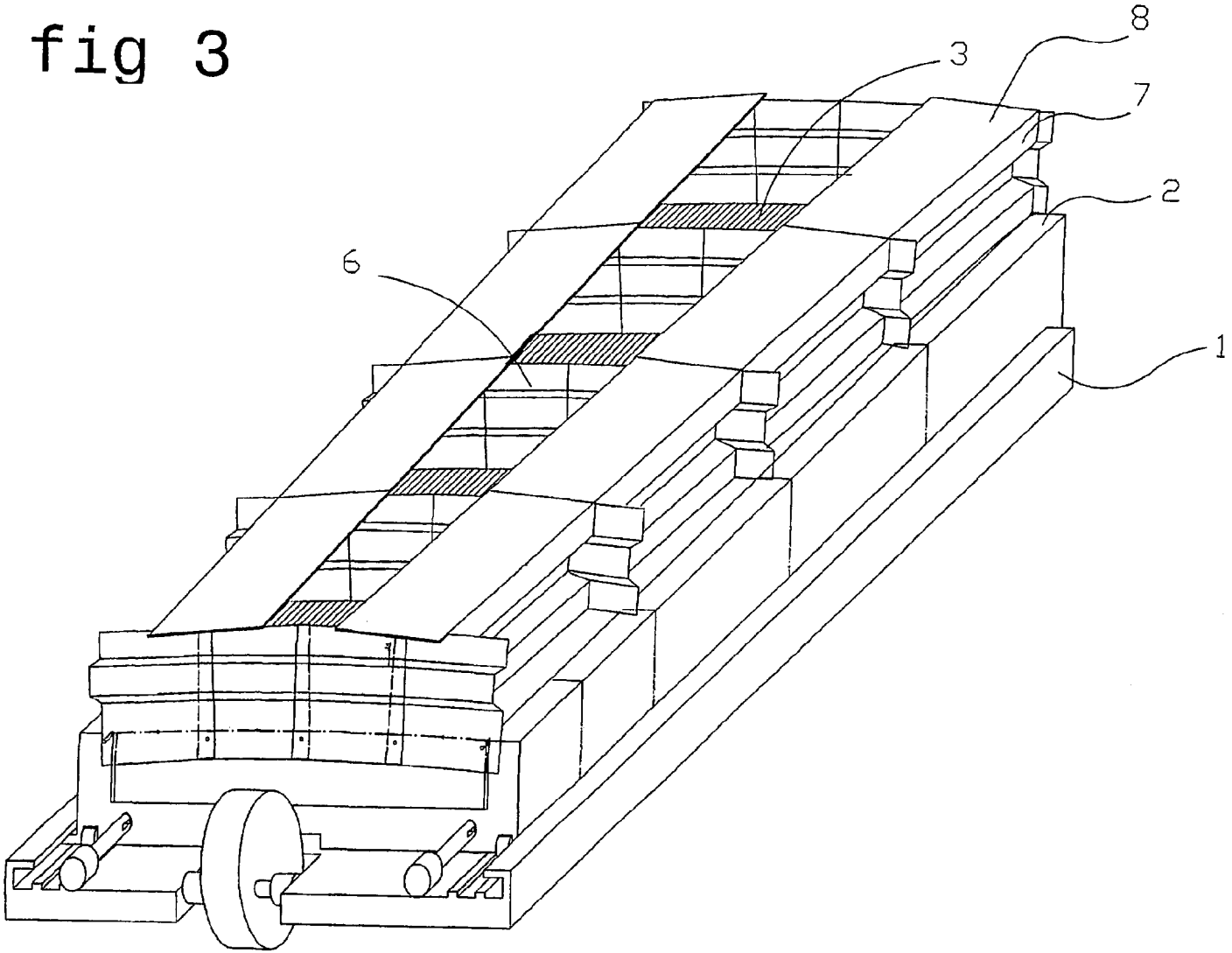
FIG. 3, represents a general view of the casting structure applicable to the manufacture of the elements of the cone-shaped ring in the casting position.
Figure 4:
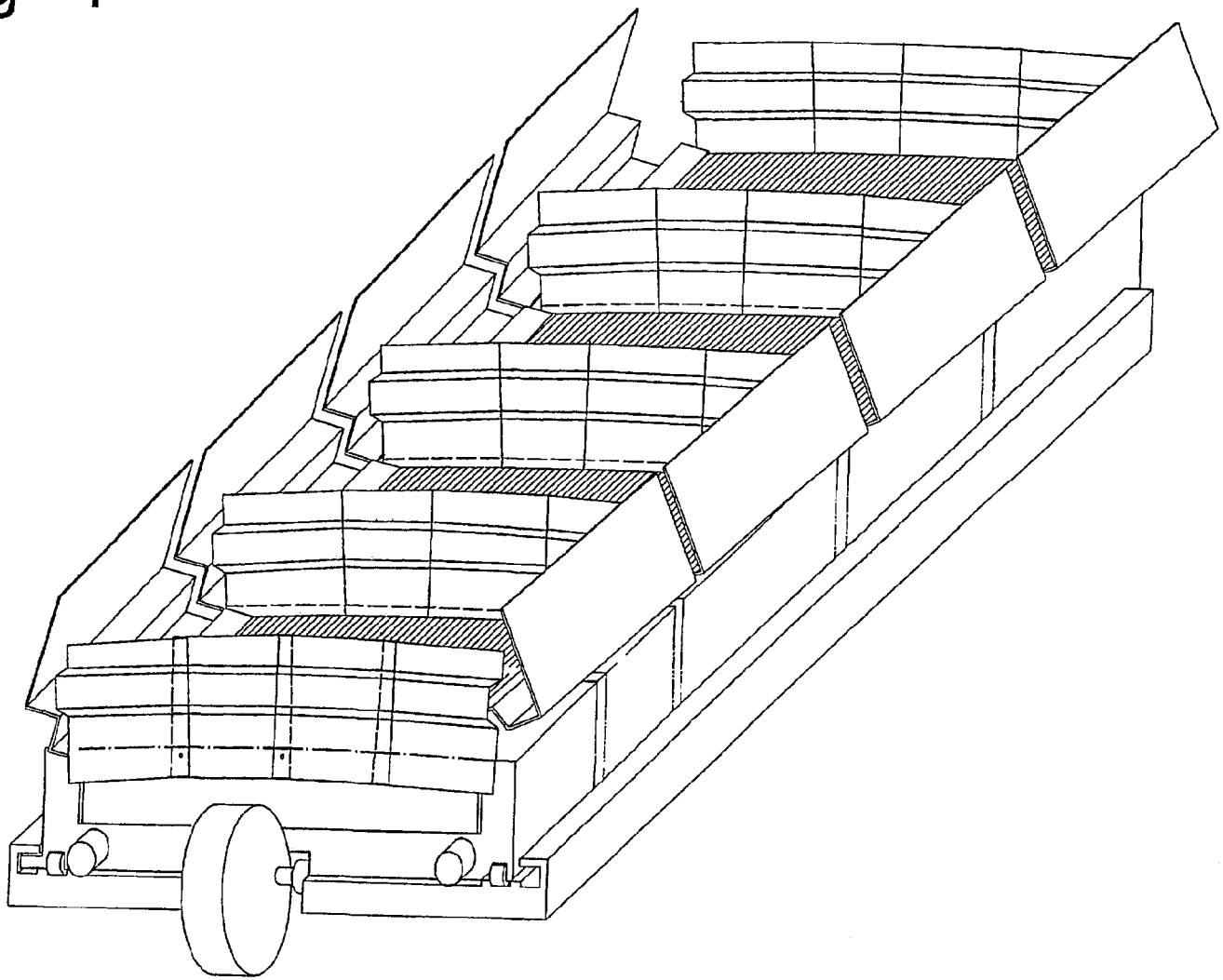
FIG. 4, represents a general view of the casting structure applicable to the manufacture of a cone-shaped ring in the position, in which the casting pieces are dismantled from the mould.

The device applicable to the method appropriate for the manufacture of cone-shaped elements, which is presented in FIGS. 3 and 4, operates in nearly the same way as the above mentioned mould. The specific characteristic is that the radial profile plates 7 are each one as long as one area to be cast and they are fixed by articulations to the arched cylinder surface 3 or the body 2 so that the plates 7 can be turned in the direction of the radius of the cone-shaped surface. The joining together of the fan profile plates 6 and plates 7 takes place in the way mentioned in the preceding chapter so that the plates 7 are first turned to their places in the direction of the cone surface, in which case the extension plates 8 form the upper boundary surfaces of the mould. Thereafter the mould blocks are pressed together, in which case the shaped ends of the plates 7 (according to the profile of the fan profile plate 6) are tightly pressed against the fan profile plates 6 reaching the longer side. The extension plates 8 are obliquely placed on the fan profile plates 6. The degree of the bias depends on how conical is the arched cylinder surface. In the present pattern of the mould the locking of the fan profile plates 6 and extension plates 8 is realized differently from hole-cantilever locking for example so that on the extension plates 8 are locking organs having the length of the mould such as bars that are locked in place by their ends, or by some other applicable way. The arched cylinder surfaces 3 which are side by side, form in this solution a uniform part of the cone-shaped surface, in which case one of each element coming to different element layers of the cone is manufactured by one cast for the number of blocks. By repeating the cast by the number of the elements in the layers, the pre-fabricated cone ring is realized. To manufacture a different point of the cone or the element of a different cone it is necessary to change in the mould new arched cylinder surfaces 3 corresponding to it or to adjust the arch surfaces of the mould to be corresponding to it. The fan profile plates 6 must be adjusted to correspond to new arch surfaces and the plates 7 must be set in arch elements. This system does not necessitate the adjustable articulation 17 in the fan profile plates 6, because the ends of the fan profile plates 6 reach further between the side plates 7, and it is possible to provide their length with the possibility of adjustment.

Differently from the above, it is possible to use in the mould of cone-shaped elements, as to the fan profile plates 6 and plates 7, the same technology as in the mould of cylinder elements, in which the plates 7 have the same length as the whole mould. Then it is necessary to set in the fan profile plates 6 at least one adjustable articulation so that their position vis-a-vis the plates 7 can be suitably adjusted. However in the structure the applicability area of the fan profile plates 6 is, due to cones, rather limited and so it is necessary to manufacture a series of fan profile plates 6 of various length. The solution according to the present invention can apply in particular to the cones with a small cone angle.

In the manufacture of the cone-shaped elements according to the method of this invention can be used the technology in which the fan profile plates 6 with rotation-like surfaces are perpendicular with the central axle of the cone surface. However it is reasonable to affirm that from the point of view of resistance of the cast piece, the more the angles are sharp, the more it is adverse. In this technology the angle unifying the visible surface to the lower surface of the cast piece is a sharp angle (<90 degrees.) at the lower end of the element. One possibility of application of this example of realization may also be the cones with a small cone angle. In that case the sharp angle is very near to a straight angle and the advantage is that the manufacture of the end surfaces of the arched cylinder surfaces 3 vertical to the central axis of the cone is in some measure simpler than their manufacture vertical to the cone surface.

One form of application of the invention is such a structure of the fan profile plates 6 in which the elements a, b, c and d are made so that they fit each arch element and are tightly fixed together by for example welding. In that case the elements a–d can be for example cut in an industrial profile pre-form. Cutting can be also realized so that it does not totally go through the pre-form in the lower edge so that the elements, which still remain attached together, can be bent to the right position. So for example they can be welded together and polished uniform or in some cases even leave as such, in which case small V-shaped gaps remain between the elements side by side (a–d). Thus the small flash formed in the cast can be taken off after the cast in certain cases of application. This structure supposes concerning the rest of the mould a structure in which the fan profile plates 6 reach between the plates 7 further than the diagonal interface so that it will not be necessary to shape their ends suitable to the profile 7.

The body 2 of the mould in connection with the invention can also be manufactured so that its breadth can be adjustable. In that case it is not necessary that the breadth of the arch blocks is a standard. This solution gives the advantage that the series of fan profile plates 6 may not be provided with the possibility of longitudinal adjustment in which case for example the series of fan profile plates 6 that are tightly fixed together are applicable together with the plates 7 having the same length as the whole mould.

The adjustment of breadth of the mould body is an applicable characteristic also in the objects in which the full circle should be divided in equal parts, as it is the case in the pipes and ducts with small diameters. As an example can be mentioned the return duct of the circulating bed boiler (the return duct of sand), the diameter of which can be ca. 1 000 mm of its size, in which case the number of the elements in it for one round trip is for example 12 pieces (=30 degrees/element).

It is also possible to manufacture according to the technology of the present invention elements whose height exceeds that of the standard element. In that case it is possible to measure the blocks of the arch element 2*a* having two elements so that one of them corresponds in its measures to the element to be manufactured. When between the blocks is placed a thin flat plate that forms the upper surface of the element, it is possible to cast the element of the uppermost coating. According to the known technology the upper surface of this element is very often a plane surface.

It is possible to manufacture according to the technology of the invention elements that are higher than normal. In that case one of the series of fan profile plates 6 must be excluded and the interface of the other end of the high element should be placed between the blocks with the appropriate size of the element 2*a*.

Figure 10:
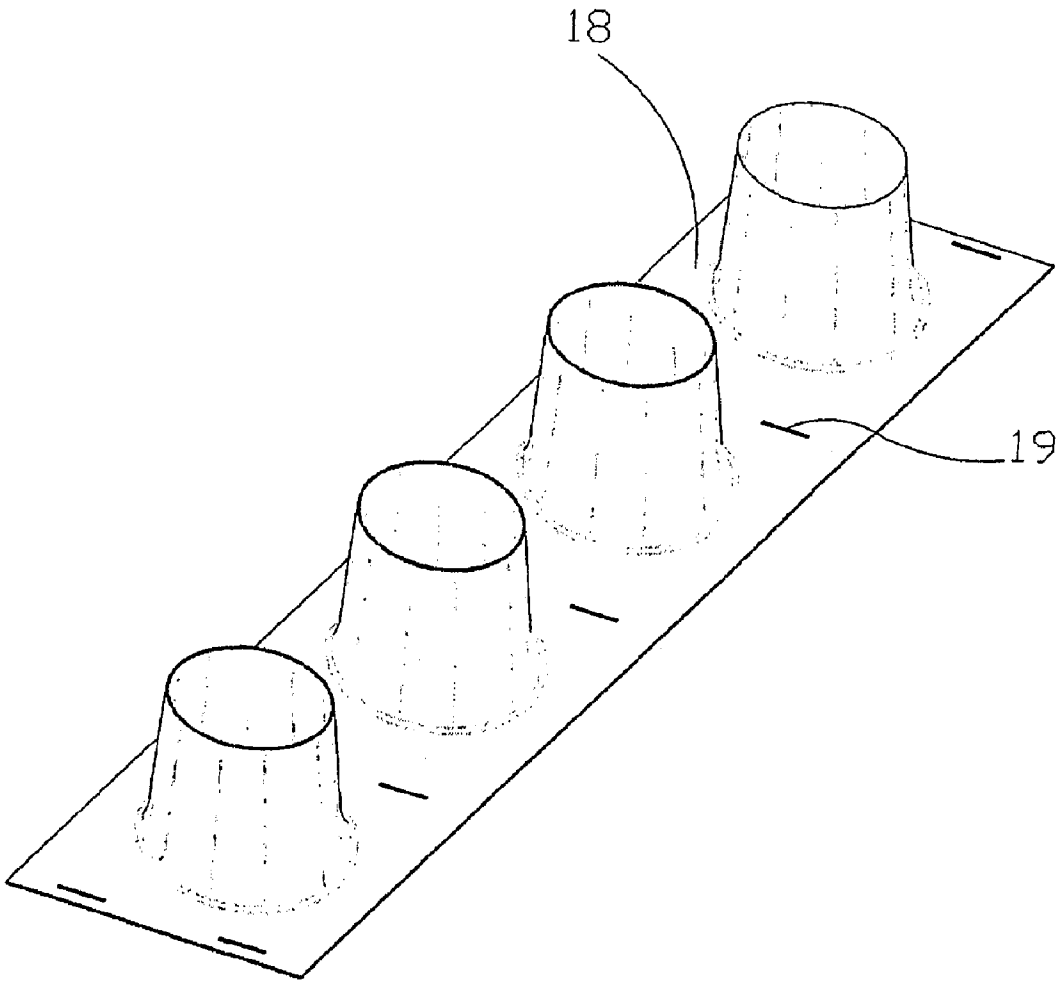
FIG. 10, represents the manufacturing element of the anchor element, part of the mould.
Figure 12:
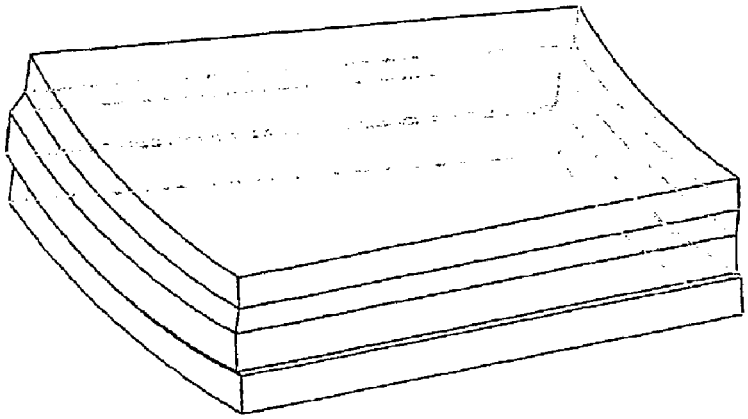
FIG. 12, represents the cast part of the cone-shaped ring.
Figure 11:
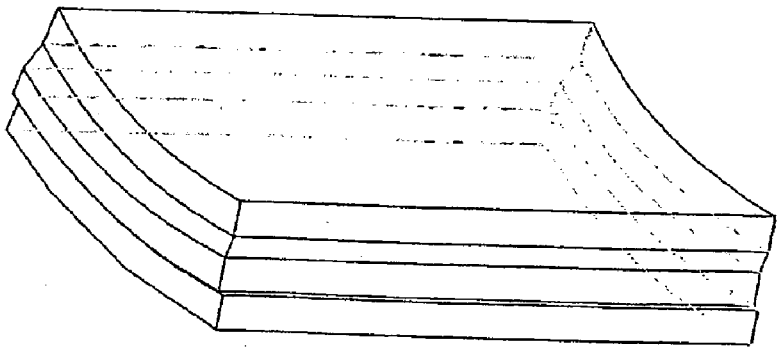
FIG. 11, represents the cast part of the cylinder ring.

According to the technology of the invention the mould to be applied also includes the devices that allow the shaping of the cast piece so that it is applicable to the anchorage of the coating. In that case there is on the outer circle of the element a part of extension, from which the anchorage is carried out. FIG. 10 represents for example the device 18 made of a steel plate, which can be fixed in the mould indicated in the FIGS. 1 and 2. When the device is set in its place so that the projecting parts of the plates 6 are pressed in the holes 19 of the device 18 and the elements are locked together, the space to be cast forms an anchor-like element. The organs of anchorage such as the sleeve and the bolt can be set in their places according to known technology.

Figure 14:
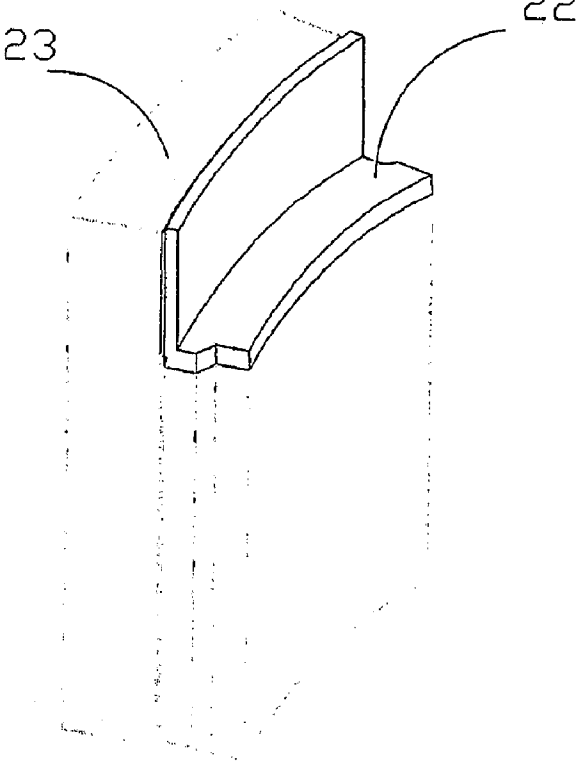
FIG. 14, represents the element, part of the mould, to be added at the manufacture of the lower element of the extension joint.
Figure 13:
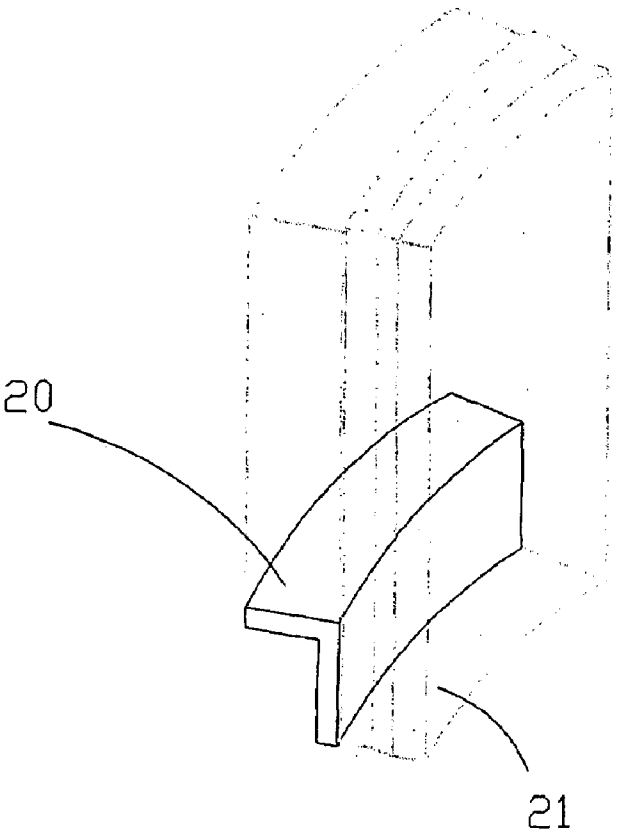
FIG. 13, represents the element, part of the mould, to be added to the mould at the manufacture of the upper element of the extension joint.
Figure 15:
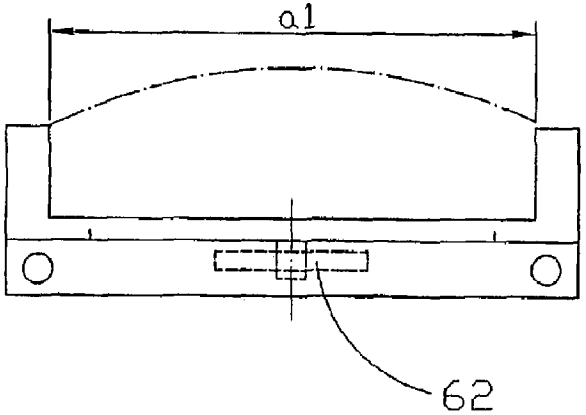
FIGS. 15 and 16 represent the body of the mould, the breadth of which is adjustable.
Figure 16:
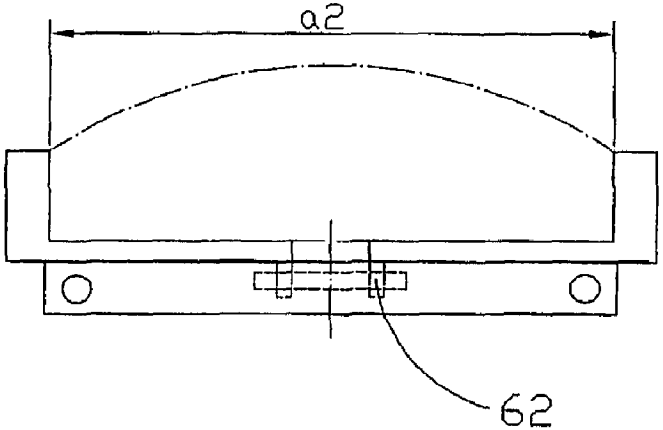

The same, the method according to the invention uses devices by which the element can be shaped to form so-called moving-seam-elements placed on or under the support shelf separating the coating elements in the moving seam. FIG. 13 represents the device 20 that is added to the mould when one wants to make the projecting part 21 passing the shelf. Then it is question of a seam element placed on the shelf. FIG. 14 represents the device 22 that is added to the mould when one wants to make the projecting part 23 on the outer circle. Then it is question of a seam element placed under the shelf. These additional devices are made of some appropriate material and they are fixed in the mould by fixing methods according to known technology.

In the above mentioned mould it is also possible to use boundary plates with a different profile from that represented in the present example. The fixing of the plates in the mould elements can be done in many applicable ways. The material of the mould can be chosen among applicable materials. For example thin stainless steel plate is well appropriate as the raw material of several elements. The thickness of the plates 6, which are articulated together, can be chosen so that the jags formed by the structure do not deteriorate the tightness or the fitness. The same the number of the plates can be chosen according to the application. The steel plates with the thickness of for example 0.75 mm and 4 elements, which are used in this example, give a result in which the small size of the jags does not deteriorate the final result nor do the cone-shaped nature of interfaces harmfully differ from the rotation surface of the corresponding profile in the element whose size is according to known technology for example 250×250 mm. The same it is possible to choose the thickness and the quality of the elements in question in the mould of the cone elements so that at the moment of placing the plates they can be placed in the cone-shaped form slightly differing from the plane surface.

Figure 17:
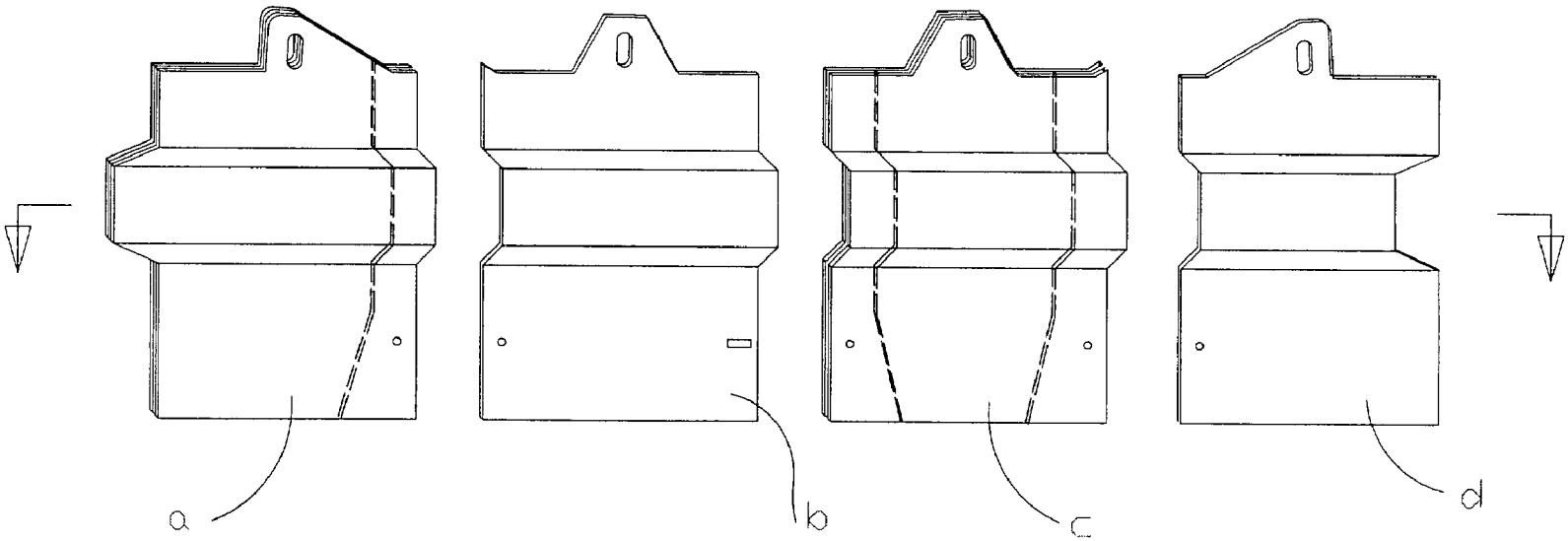
FIG. 17 represents individual plates (a–d), each of which was made so, that they can joint together by a groove joint.
Figure 18:
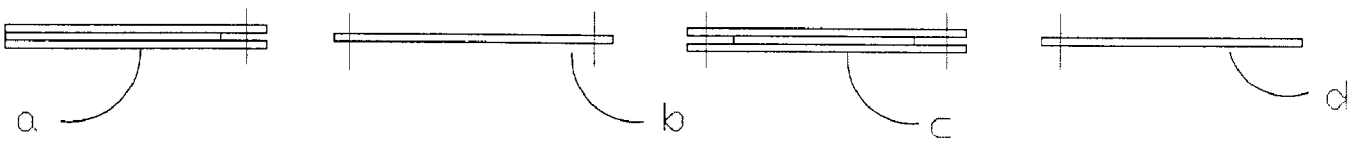
FIG. 18 is sectional figure according to arrows in FIG. 17.

Each part of the fan profile plate 6 (a–d) can consist of one or more than one plate which is installed side by side so that the plates a–d can be installed together for example by a groove joint (FIGS. 17 and 18).

The arched cylinder surfaces 3 can be either adjustable as to their radius or non-reusable. For example plywood can be a non-reusable material in which case the manufacture costs stay low. Concerning a permanent adjustable arched cylinder surface we can mention for example the structure in which there is behind the surface plate with sufficient rigidity and malleability a support structure that allows the changing of the arching of the mould surface by means of adjustment.

The shaping of the plates 6 can be realized so that the surfaces limited to the concerned plate of the elements manufactured in different places can be fitted to each other by a seam, the thickness of which corresponds in all parts to the conditions of the technology known today (mortar). The same, the profiling of the diagonal interface plates 7 can be realized so that the profile surfaces created on different boundaries of the mould can be fitted together considering the conditions of fixing technology (thickness of mortar layer).

It should be noticed that even though this description is limited to represent only one type of realization examples, the intention is not to limit in any way the use of the invention to only the present example, as many changes are possible in the framework of the invention idea defined by the patent claims.

What is claimed is:

1. A method for manufacturing at least one piece having the form of a round ring and being symmetric regarding two levels comprising:

a cast mould with at least two profile plates movably attached to the mould forming part of the mould and forming an opening for filling the mould, the profile plates having mutually matching profile surfaces; and fan profile plates which are perpendicular with a central axle of the cylinder surface so that an interior radius of the fan profile plate corresponds to a respective radius of the cylinder surface, the fan profile plates being around the central axle of the cylinder surface and in the extension corresponding to the extent of concerned surface;

wherein a convex cylinder surface is either placed in a separate changeable element of the mould, in which it can be changed to an arched surface having a different radius, or placed in the element of the mould having a radius that can be adjusted, and each of the fan profile plates perpendicular with the cylinder surface is assembled of straight profile plates, each of the fan profile plates comprises at least two side by side installed plates placed in extension of each other and placed adjacently or attached to each other so that they form a rotation surface, the central point of the rotation surface is in the central axle of the cylinder surface.

2. A method according to claim 1, wherein the profile of the profile plates of boundary surfaces of the mould is shaped so that the surfaces to be joined (female/male) of the elements manufactured in different places can be joined together wherein the length of the string of the changeable or adjustable arched cylinder surfaces of the mould is standard.

3. A method according to claim 1, wherein each of the profile plates forming boundary surfaces, which are perpendicular with the central axle of the cylinder surface, the cone surface and the central axle of the cone-shaped surface, is placed beside the adjacent plate/plates so that they all are mutually oblique in their fixing point.

4. A method according to claim 1, wherein each of the plates forming boundary fan profile plates are perpendicular with the central axle of the cylinder surface, the cone-shaped surface and the central axle of the cone surface, is tightly fixed beside the adjacent plate/plates by welding, soldering and/or when a pre-form is used by only partly detaching or by any other applicable way so that the position of an individual profile plate is side by side or end by end in respect to the adjacent profile plate/plates.

5. A method according to claim 4, wherein each of the profile plates forming boundary fan profile plates are perpendicular with the central axle of the cylinder surface, the cone surface and the central axle of the cone surface, is fixed in the adjacent profile plate/plates by an articulation body, in which case the mutual position of the adjacent profile plates can be regulated. over the articulation.

6. A method according to claim 4, wherein a maximum thickness of the fitted fan profile plate is twice the thickness of an individual profile plate.

7. A method according to claim 6, wherein a central point of an articulation body is placed in a circle corresponding to the arch of the cylinder or cone surface.

8. A method according to claim 7, wherein an angle between the profile plates is permanently a straight angle.

9. A method according to claim 6, wherein at least one articulation linking the boundary profile plates is made suitable to the adjustment of the total length of the fan profile plates, so that it allows the moving of an articulation axle in a longitudinal hole, so that the length of the plate series can be regulated to correspond to the length of the arc of the arched cylinder surface.

10. A method according to claim 1, wherein the profile plates forming radial boundary surfaces are hinged at a lower edge of the profile plates to a body of the mould or the cylinder or cone surface by hinge element(s) so that the central lines of the hinge points are placed in the joining points of the radial boundary profile plates and the cylinder or cone surface and the mould, and/or the profile plates are turned to boundary surfaces following the radius of the space to be cast when the mould is in the casting position, and outside from the casting piece over the hinge when the casting piece is in the position for emptying, in which case the casting piece can be taken away upwards between the profile plate.

11. A method according to claim 1, wherein the profile plates forming the boundary surfaces of casting space are made in some way to reach and turn over the mould to upper boundary surfaces of the mould.

12. A method according to claim 1, wherein the mould is assembled of at least two spaces to be cast, which are joined together when the mould is in the position of casting, so that the convex cylinder or cone surfaces of the mould extend each other and are separated from each other by the fan profile plates forming the boundary surfaces that are perpendicular with the cylinder or cone surface or its central axle, and the cast spaces have been moved separate from each other in order to take away the casting pieces.

13. A method according to claim 1, wherein two of the boundary fan profile plates are fixed in the same part of a body of the mould and each one of the others in different parts of the body, and that the cylinder or cone surface of the part of the body having two boundary fan profile plates, has two parts.

14. A method according to claim 13, wherein the body is assembled of as many parts as it contains surfaces, and that the parts are placed on the parts of the body corresponding to their length and breadth.

15. A method according to claim 1, wherein parts of the body of the mould are placed on a stand so that they can be moved with respect to each other in the longitudinal direction of the mould by the transfer bodies such as holding axles or wheels, in which case there can be formed gaps between the parts of body, and that the part of the body having two boundary fan profile plates can also be removed with respect to each other in the longitudinal direction, in which case a gap can be formed between blocks.

16. A method according to claim 1, wherein a body of the mould is made so that its breadth can be regulated by means of regulation bodies in it.

17. A method according to claim 1, wherein the mould has elastic boundary profile plates.

18. A method according to claim 1, wherein an extension element creating a form of an anchor element, or a reducing element creating a form of a moving seam element are fixed in the mould.

19. A method for manufacturing at least one piece having the form of a cone-shaped ring element that is symmetric regarding one level comprising:

a cast mould with at least two profile plates movably attached to the mould forming part of the mould and forming an opening for filling the mould, the profile plates having mutually matching profile surfaces; and fan profile plates which are perpendicular with the cone surface or a central axle of the cone-shaped surface, the fan profile plates are rotation surfaces being around the central axle of the cone-shaped surface of the mould, so that an interior radius of the fan profile plate corresponds to a respective radius of the convex cone surface and so that the largeness of the surface corresponds to the extent of the cone-shaped surface;

wherein the convex cone surface of the mould is either placed in an element of the separate changeable mould, in which it can be changed to a cone-shaped surface having other measures or placed in the adjustable element of the mould, and each of the fan profile plates, perpendicular with the cone surface or the central axle of the cone-shaped surface, is assembled of the profile plates, each of which comprises at least two side by side advantageously installed plates which are straight before their fitting, placed in extension of each other and placed adjacently or attached to each other so that they form a rotation surface, the central point of the rotation surface is in the central axle of the cone surface.

* * * * *